US006666425B1

(12) United States Patent
Ferguson

(10) Patent No.: US 6,666,425 B1
(45) Date of Patent: Dec. 23, 2003

(54) VERTICALLY-ADJUSTABLE PICTURE HANGAR

(76) Inventor: Jerry Lee Ferguson, 1231 N. 260 West, Orem, UT (US) 84057

( * ) Notice: Subject to any disclaimer, the term of this patent is extended or adjusted under 35 U.S.C. 154(b) by 0 days.

(21) Appl. No.: 10/337,515

(22) Filed: Jan. 6, 2003

(51) Int. Cl.[7] ..... A47G 1/24; B60R 1/02

(52) U.S. Cl. ..... 248/477; 248/476; 248/495; 248/496

(58) Field of Search ..... 248/476, 477, 248/480, 497, 496, 495

(56) References Cited

U.S. PATENT DOCUMENTS

| | | | | | |
|---|---|---|---|---|---|
| 2,975,994 | A | | 3/1961 | Goss | |
| 3,360,229 | A | * | 12/1967 | Beyer | 248/496 |
| 3,900,923 | A | * | 8/1975 | Thomas | 24/16 PB |
| 3,945,599 | A | * | 3/1976 | Spier et al. | 248/476 |
| 4,340,199 | A | * | 7/1982 | Brock | 248/544 |
| 4,557,455 | A | * | 12/1985 | Benjamin | 248/496 |
| 4,623,177 | A | * | 11/1986 | McKinney | 292/87 |
| 5,040,712 | A | * | 8/1991 | Pesonen et al. | 224/547 |
| 5,480,120 | A | * | 1/1996 | Bruner | 248/477 |
| 5,584,462 | A | * | 12/1996 | Reese | 248/477 |
| 6,003,825 | A | * | 12/1999 | Abernathy, Jr. | 248/478 |
| 6,299,123 | B1 | * | 10/2001 | Hayde | 248/476 |

* cited by examiner

*Primary Examiner*—Leslie A. Braun
*Assistant Examiner*—Amy J. Sterling
(74) *Attorney, Agent, or Firm*—Angus C. Fox, III

(57) ABSTRACT

A vertically adjustable wall hanger includes a main body that is securable to a vertical surface with mounting screws, nails, or other similar fasteners, and an adjustable bracket. The main body includes a pair of mounting apertures and is generally symmetrical about a plane passing through the axes of the mounting apertures. The main body also includes a vertically-oriented linear ratchet having a plurality of teeth, and a pair of parallel, outwardly-facing, spaced-apart peripheral tracks or grooves. Each of the tracks is open at the top of the main body. The adjustable bracket includes a pair of cylindrical locator pins that enter the tracks at the top of the main body and slide within them. The adjustable bracket also includes a pawl that engages the linear ratchet. The locator pins allow the adjustable bracket to be rotated upwardly, so that the pawl may be disengaged from the linear ratchet, the adjustable bracket moved up or down, and the pawl re-engaged with the ratchet.

18 Claims, 2 Drawing Sheets

VERTICALLY-ADJUSTABLE PICTURE HANGAR

BACKGROUND OF THE INVENTION

1. Field of the Invention

This invention relates to wall hanging devices and more particularly pertains to an adjustable wall hanger for adjustably suspending an object from a wall.

2. Description of the Prior Art

The use of wall hanging devices is well known in the prior art. Despite the myriad designs for picture hangars which crowd the field of issued patents, the most common picture hangars are still those which are fabricated as a generally J-shaped hook from a single bent metal strip, having a pair of opposed axially-aligned holes therein on an inclined axis for mounting the hook to a vertical surface and an upwardly-bent portion at the bottom thereof for holding a cable or wire. It appears that cost, rather than improved utility or function, is the overriding force in the purchase of picture hanging devices by consumers.

While the prior art wall hanging devices fulfill their respective, particular objectives and requirements, the prior art does not disclose an adjustable wall hanger for adjustably suspending an object from a wall, which may be inexpensively manufactured and which includes a linear ratchet portion having parallel, outwardly-facing tracks securable to a wall surface and a pawl-bracket portion, rotatable about a horizontal axis, slidably positionable along the tracks and including both a pawl for engaging the linear ratchet portion and a depending hook for suspending an object therefrom.

In these respects, the adjustable wall hanger according to the present invention substantially departs from the conventional concepts and designs of the prior art, and in so doing provides an apparatus primarily developed for the purpose of adjustably suspending an object from a wall.

SUMMARY OF THE INVENTION

In view of the foregoing disadvantages inherent in the known types of wall hanging devices now present, in the prior art, the present invention provides a new adjustable wall hanger which provides for vertical adjustability of a hanging object. The new vertically adjustable wall hanger includes a main body that is securable to a vertical surface with mounting fasteners (such as screws, nails, or other similar fasteners) and an adjustable bracket. The main body includes a pair of mounting apertures and is generally symmetrical about a plane passing through the axes of the mounting apertures. The main body also includes a vertically-oriented linear ratchet having a plurality of teeth, and a pair of parallel, outwardly-facing, spaced-apart peripheral tracks or grooves. Each of the tracks is open at the top of the main body. The adjustable bracket has a front portion with a pawl for engaging any of the teeth of the linear ratchet, and a pair of laterally-spaced, opposed, rearward-facing ears. Each of the ears has a cylindrical locator pin that is axially aligned with and faces the locator pin of the opposing ear. The locator pins being spaced apart so that both may simultaneously enter and engage the tracks at the top of the main body and slide within them, thereby retaining the adjustable bracket slidably attached to the main body. The locator pins allow the adjustable bracket to be upwardly rotated about an adjustment axis passing through the center of each locator, so that the pawl may be disengaged from the linear ratchet and the adjustable bracket moved up and down within the tracks. When the adjustable bracket has been downwardly rotated, and the pawl has once again engaged a tooth of the linear ratchet, gravity ensures that the pawl remains securely engaged with tooth. The front portion of the adjustable bracket also incorporates an upwardly-facing transverse groove, which is sized to receive a picture frame hanging cable or wire. Both the main body and the adjustable bracket are preferably fabricated from a structural polymeric "plastic" material, such as polystyrene, ABS, acrylic, or poly vinyl chloride, via an injection molding process. Such method of manufacture ensures that the components may be produced cheaply and with little variabiltiy.

DETAILED DESCRIPTION OF THE INVENTION

The structure and operation and utility of the new, vertically-adjustable picture hanger will now be described with reference to the accompanying twelve drawing figures. It should be understood that although the invention is referred to as a picture hangar, it may be used to secure a variety of items, such as framed paintings, photographs, pictures and mirrors to a vertical surface. Thus in the claims, it is referred to as a wall hangar device.

Figure 1:
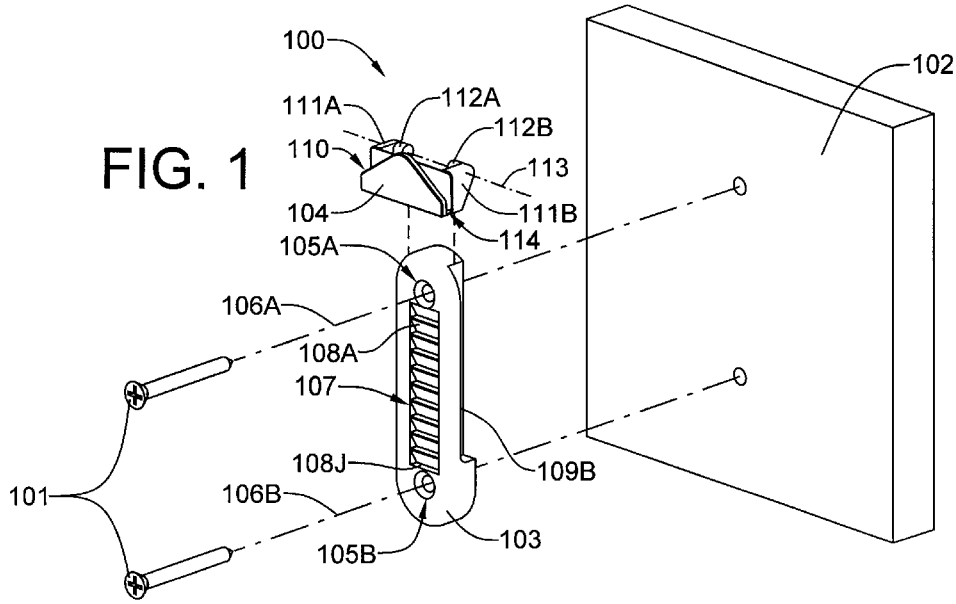
FIG. 1 is an isometric exploded view of the vertically-adjustable picture hangar and a section of wall which it is to be mounted.

Referring now to FIG. 1, the vertically-adjustable picture hangar 100 is shown in combination with a pair of mounting screws 101 and a wall section 102 to which it will be mounted. The picture hangar 100 comprises a pair of components which may be assembled as a unit, namely a main body 103 that is securable to a vertical surface with the mounting screws 101 or other similar fasteners, and an adjustable bracket 104. The main body 103 includes a pair of mounting apertures 105 and is symmetrical about a plane passing through the axes 106A and 106B of the mounting apertures 105. The main body 103 also includes a vertically-oriented linear ratchet 107 having a plurality of teeth 108A through 108J, and a pair of parallel, outwardly-facing, spaced-apart peripheral tracks or grooves 109A and 109B (only track 109B is visible in this view). Each of the tracks 109A and 109B is open at the top of the main body 103. The adjustable bracket 104 has a front portion 110 with a pawl (not shown in this view) for engaging any of the teeth 108A through 108J of the linear ratchet 107, and a pair of laterally-spaced, opposed, rearward-facing ears 111A and 111B. Each ear 111A or 111B has associated therewith a cylindrical locator pin, 112A or 112B, respectively, that is axially aligned with and faces the locator pin of the opposing ear. The locator pins 112A and 112B are spaced apart so that both may simultaneously enter and engage the tracks 109A and 109B at the top of the main body 103 and slide within them, thereby retaining the adjustable bracket 104 slidably attached to the main body 103. The locator pins 112A and 112B also allow the adjustable bracket 104 to be upwardly rotated about an adjustment axis 113 passing through the center of each locator pin 112A and 112B, so that the pawl may be disengaged from the linear ratchet 107and the adjustable bracket 104 moved up and down within the tracks 109A and 109B. When the adjustable bracket 104 has been downwardly rotated, and the pawl has once again engaged on of the teeth 108A through 108J of the linear ratchet 107, gravity ensures that the pawl remains securely engaged with the selected tooth. The front portion 110 of the adjustable bracket 104 also incorporates an upwardly-facing transverse groove 114, which is sized to receive a picture frame hanging cable or wire.

Figure 2:
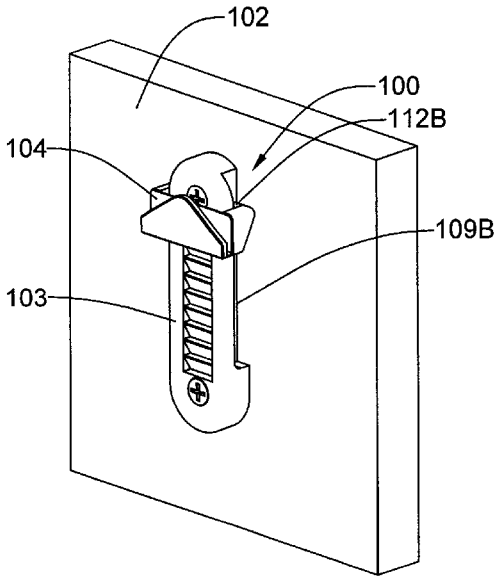
FIG. 2 is an isometric view of a fully assembled vertically-adjustable picture hangar mounted on a section of wall.

Referring now to FIG. 2, the vertically-adjustable picture hangar 100 has been assembled and mounted on the wall section 102. It will be noted that the adjustable bracket 104 has been slid over the main body 103, with the locator pins 112A and 112B engaging tracks 109A and 109B, respectively.

Figure 3:
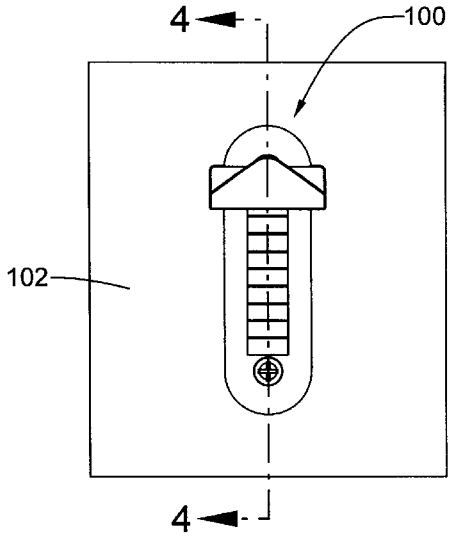
FIG. 3 is a front elevational view of the vertically-adjustable picture hangar.

Referring now to FIG. 3, it will be noted that the vertically-adjustable picture hangar 100 is symmetrical about the section line 4—4. Operation and adjustment of the vertically-adjustable picture hangar 100 will become clear in FIGS. 4 through 7, which are based on a cross-sectional view of the picture hangar 100, taken through section line 4—4.

Figure 4:
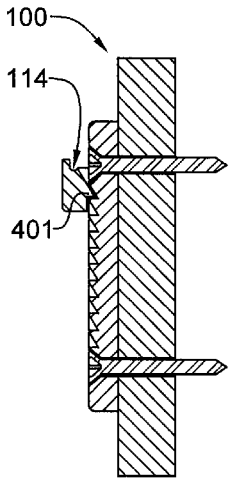
FIG. 4 is a right-side, cross-sectional view of the vertically-adjustable picture hangar of FIG. 3, taken through section line 4—4.

Referring now to FIG. 4, the pawl 401 on the adjustable bracket 104 is clearly visible. It will be noted that, as adjusted in this view, the pawl 401 engages tooth 108A of the linear ratchet 107. It will also be noted that each of the mounting screws 101 pierces the wall section 102. The transverse groove 114, which is sized to support a picture hanging wire or cable (not shown), is also visible in this view.

Figure 5:
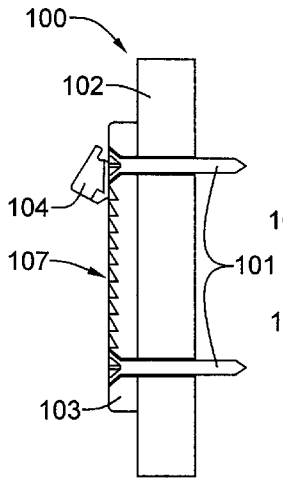
FIG. 5 is a right-side, cross-sectional view of the vertically-adjustable picture hangar of FIG. 4 following upward rotation of the wire support clip.

Referring now to FIG. 5, the adjustable bracket 104 has been upwardly rotated, thereby disengaging the pawl 401 from tooth 108A. The locator pins 112A and 12B serve as the pivot points. Once the pawl 401 has been disengaged from the linear ratchet 107, the adjustable bracket 104 may be moved freely up and down within the tracks 109A and 109B.

Figure 6:
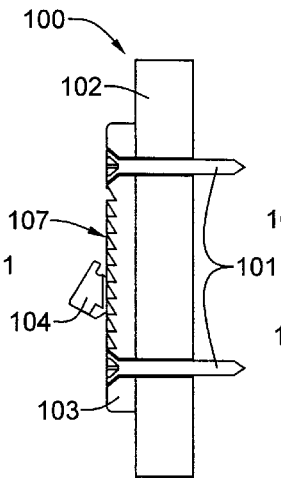
FIG. 6 is a right-side, cross-sectional view of the vertically-adjustable picture hangar of FIG. 5 following slidable repositioning of the wire support clip to a lower position.

Referring now to FIG. 6, with the pawl 401 disengaged from the linear ratchet 107, the adjustable bracket 104 has been slid downwardly.

Figure 7:
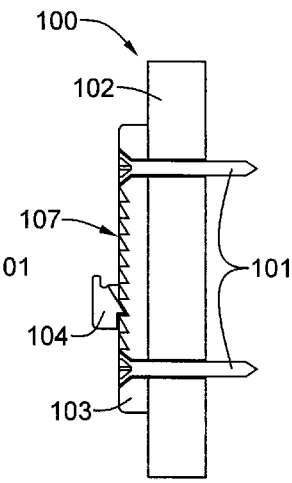
FIG. 7 is a right-side, cross-sectional view of the vertically-adjustable picture hangar of FIG. 6, following the downward rotation of the wire support clip.
Figure 8:
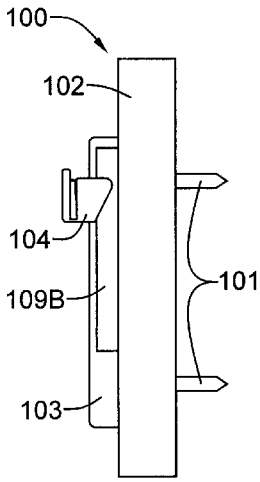
FIG. 8 is a right-side, elevational view of the vertically-adjustable picture hangar of FIG. 3.
Figure 9:
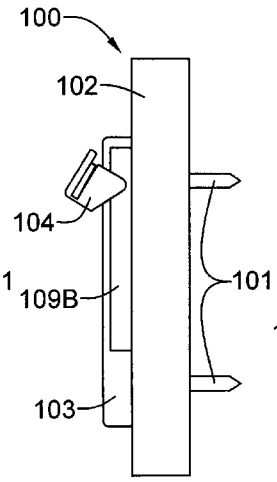
FIG. 9 is a cross-sectional view of the vertically-adjustable picture hangar of FIG. 8 following upward rotation of the wire support clip.
Figure 10:
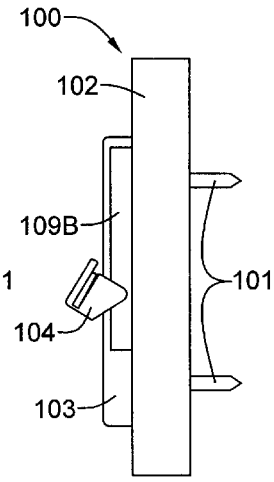
FIG. 10 is a cross-sectional view of the vertically-adjustable picture hangar of FIG. 9 following slidable repositioning of the wire support clip to a lower position.
Figure 11:
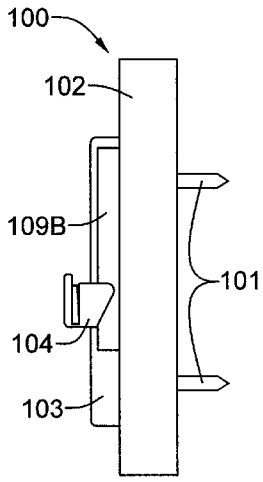
FIG. 11 is a cross-sectional view of the vertically-adjustable picture hangar of FIG. 10, following the downward rotation of the wire support clip.

Referring now to FIG. 7, the adjustable bracket 104 has been downwardly rotated, thereby engaging the pawl 401 with tooth 108H. Gravity ensures that the pawl 401 of adjustable bracket 104 remains securely engaged with tooth 108H.

FIGS. 8 through 11, which are right side views of the picture hangar 100, correspond to FIGS. 4 through 7, respectively. The track 109A is clearly and fully visible in this view, as is the groove 402.

Figure 12:
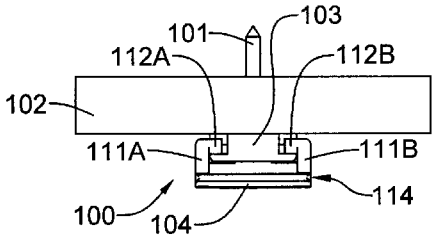
FIG. 12 is a top planar view of the vertically-adjustable picture hangar of FIG. 3.

Referring now to the top view of FIG. 12, both tracks 109A and 109B are clearly visible, as are the cylindrical locator pins 112A and 112B.

Both the main body 103 and the adjustable bracket 104 are preferably fabricated from a structural polymeric "plastic" material, such as polystyrene, ABS, acrylic, or poly vinyl chloride, via an injection molding process. Such method of manufacture ensures that the components may be produced cheaply and with little variabiltiy.

Although only several embodiments of the invention has been heretofore described, it will be obvious to those having ordinary skill in the art that changes and modifications may be made thereto without departing from the scope and the spirit of the invention as hereinafter claimed.

What is claimed is:

1. A vertically-adjustable wall hangar device comprising:

a main body having at least two mounting apertures, said main body being securable to a vertical surface with mounting fasteners passing through the mounting apertures, said main body also having a vertically-oriented linear ratchet with a plurality of evenly-spaced teeth, and a pair of parallel, outwardly-facing, spaced-apart peripheral tracks; and an adjustable bracket having a pair of opposed, inwardly-facing cylindrical locator pins, which are spaced apart so that both may simultaneously engage and slide within the parallel tracks of the main body, said adjustable bracket also having a pawl which may engage any of the teeth of the linear ratchet wherein said locator pins allow said adjustable bracket to be upwardly rotated about an adjustment axis passing through the center of each locator pin, so that the pawl may be disengaged from the linear ratchet and the adjustable bracket moved up and down within the tracks.

2. The vertically-adjustable wall hangar device of claim 1, wherein said main body is generally symmetrical about a plane passing through the axes of the mounting apertures.

3. The vertically-adjustable wall hangar device of claim 1, wherein each of the tracks is open at the top of the main body.

4. The vertically-adjustable wall hangar device of claim 1, wherein gravity acting on the adjustable bracket ensures that the pawl, once rotated in a downwardly direction, remains securely engaged with a tooth of the linear ratchet.

5. The vertically-adjustable wall hangar device of claim 1, wherein both the main body and the adjustable bracket are fabricated from a structural polymeric "plastic" material.

6. The vertically-adjustable wall hangar device of claim 5, wherein the structural plastic material is selected from the group consisting of polystyrene, ABS, acrylic, or poly vinyl chloride.

7. The vertically-adjustable wall hangar device of claim 5, wherein both the main body and the adjustable bracket are fabricated using an injection molding process.

8. The vertically-adjustable wall hangar device of claim 1, wherein said adjustable bracket further includes an upwardly-facing transverse groove, which is sized to receive and support a frame hanging wire or cable.

9. A vertically-adjustable wall hangar device comprising:

a main body securable to a vertical surface with mounting fasteners, said main body having a vertically-oriented linear ratchet with a plurality of teeth, and a pair of parallel, outwardly-facing, spaced-apart, vertically-oriented peripheral tracks; and an adjustable bracket having a front portion with a pawl for engaging any of the teeth of the linear ratchet, and a pair of laterally-spaced, opposed, rearward-facing ears, each ear having a cylindrical locator pin that is axially aligned with and facing the locator pin of the opposing ear, said locator pins being spaced apart so that both may simultaneously engage and slide within the parallel tracks of the main body and retain the adjustable bracket slidably attached to the main body wherein said locator pins allow said adjustable bracket to be upwardly rotated about an adjustment axis passing through the center of each locator pin, so that the pawl may be disengaged from the linear ratchet and the adjustable bracket moved up and down within the tracks.

10. The vertically-adjustable wall hangar device of claim 9, wherein each of the teeth of said vertically-oriented linear ratchet are evenly spaced.

11. The vertically-adjustable wall hangar device of claim 9, wherein said main body has at least two mounting apertures, through which said mounting fasteners are inserted.

12. The vertically-adjustable wall hangar device of claim 11, wherein said main body is generally symmetrical about a plane passing through the axes of the mounting apertures.

13. The vertically-adjustable wall hangar device of claim 9, wherein each of the tracks is open at the top of the main body.

14. The vertically-adjustable wall hangar device of claim 9, wherein gravity acting on the adjustable bracket ensures that the pawl, once rotated in a downwardly direction, remains securely engaged with a tooth of the linear ratchet.

15. The vertically-adjustable wall hangar device of claim 9, wherein said adjustable bracket further includes an upwardly-facing transverse groove, which is sized to support a frame hanging wire or cable.

16. The vertically-adjustable wall hangar device of claim 9, wherein both the main body and the adjustable bracket are fabricated from a structural polymeric "plastic" material.

17. The vertically-adjustable wall hangar device of claim 15, wherein the structural plastic material is selected from the group consisting of polystyrene, ABS, acrylic, or poly vinyl chloride.

18. The vertically-adjustable wall hangar device of claim 16, wherein both the main body and the adjustable bracket are fabricated using an injection molding process.

* * * * *